US006932159B2

(12) United States Patent
Hovem

(10) Patent No.: US 6,932,159 B2
(45) Date of Patent: Aug. 23, 2005

(54) RUN IN COVER FOR DOWNHOLE EXPANDABLE SCREEN

(75) Inventor: Knut A. Hovem, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/231,821

(22) Filed: Aug. 28, 2002

(65) Prior Publication Data

US 2004/0040723 A1 Mar. 4, 2004

(51) Int. Cl.[7] ..... E21B 43/10

(52) U.S. Cl. ..... 166/296; 166/227; 166/376; 166/381

(58) Field of Search ..... 166/381, 376, 166/296, 227, 382

(56) References Cited

U.S. PATENT DOCUMENTS

| | | | | |
|---|---|---|---|---|
| 2,419,313 A | * | 4/1947 | Byrd | 166/143 |
| 3,099,318 A | | 7/1963 | Miller et al. | |
| 3,880,233 A | * | 4/1975 | Muecke et al. | 166/205 |
| 5,355,956 A | | 10/1994 | Restarick | |
| 5,366,012 A | | 11/1994 | Lohbeck | |
| 5,443,121 A | | 8/1995 | Saucier | |
| 5,617,919 A | | 4/1997 | Saucier | |
| 5,901,789 A | | 5/1999 | Donnelly et al. | |
| 6,263,966 B1 | | 7/2001 | Haut et al. | |
| 6,315,040 B1 | * | 11/2001 | Donnelly | 166/207 |
| 6,354,373 B1 | | 3/2002 | Vercaemer et al. | |
| 6,460,759 B1 | * | 10/2002 | Lowry et al. | 229/201 |
| 6,523,611 B1 | * | 2/2003 | Bakker et al. | 166/298 |
| 6,543,545 B1 | * | 4/2003 | Chatterji et al. | 166/381 |
| 6,571,871 B2 | * | 6/2003 | Lauritzen et al. | 166/227 |
| 6,607,032 B2 | * | 8/2003 | Voll et al. | 166/227 |

FOREIGN PATENT DOCUMENTS

| | | | |
|---|---|---|---|
| WO | WO 00/39432 | * | 7/2000 |
| WO | WO 02/075108 A1 | | 9/2002 |
| WO | WO 02/092962 A1 | | 11/2002 |

* cited by examiner

*Primary Examiner*—Hoang Dang
(74) *Attorney, Agent, or Firm*—Steve Rosenblatt

(57) ABSTRACT

A screen to be expanded when placed downhole is disclosed. The screen is delivered to the location with a cover that blocks access to the screen from well fluids. Circulation or reverse circulation can be undertaken with no appreciable flow through the screen due to placement of the cover. In one embodiment the cover has slits that open to be diamond shapes upon expansion of the underlying screen. In another embodiment, the openings are created by shapes that have a weakened edge that, as a result of expansion break off to create available openings for flow.

19 Claims, 1 Drawing Sheet

RUN IN COVER FOR DOWNHOLE EXPANDABLE SCREEN

FIELD OF THE INVENTION

The field of this invention is expandable downhole screens and more particularly, a cover for the screen for run in that blocks flow through the screen and upon expansion permits flow through the screen.

BACKGROUND OF THE INVENTION

Screens are now being expanded downhole to take the place of a gravel packing operation. Several U.S. Patents reveal the technology used to expand screens downhole. A few examples are U.S. Pat. Nos. 5,901,789; 6,315,040 and 5,366,012. In running screens to the desired position in the wellbore, there was a problem of screen plugging before expansion could take place. The fact that the screen openings were exposed also precluded forced circulation to remove wellbore debris before expanding the screen.

In the past, screens that were not expanded were covered with a movable sleeve. In U.S. Pat. Nos. 5,443,121 and 5,617,919, a movable sleeve was used to facilitate distribution of gravel outside the screen. U.S. Pat. No. 5,355,956 shows a cover sleeve over a screen with sacrificial plugs in holes that are eventually removed after the screen is positioned by introducing a chemical to dissolve the plugs. Finally, U.S. Pat. No. 3,099,318 shows a sheath or belts around a multi-layered filter material to compress it for run in. When the assembly is in place a chemical is introduced to remove the sheath or bands and allow the filter layers to expand to their natural thickness. The sheath or rings for compression can also be released by defeating a lock when the screen is in the desired position downhole. Compression of the screen is required so that it can run downhole where it can later expand and work more efficiently, according to this reference.

The present invention allows the openings in the screen to be closed during run in and downhole fluid circulation or reverse circulation. When the screen is expanded, the covering on the screen allows flow by a variety of techniques. The covering can be ripped off due to expansion or openings in the covering can develop due to the screen expansion, to name a few techniques. These and other aspects of the present invention will be more readily appreciated by one skilled in the art from a review of the description of the preferred embodiment and the claims, which appear below.

SUMMARY OF THE INVENTION

A screen to be expanded when placed downhole is disclosed. The screen is delivered to the location with a cover that blocks access to the screen from well fluids. Circulation or reverse circulation can be undertaken with no appreciable flow through the screen due to placement of the cover. In one embodiment the cover has slits that open to be diamond shapes upon expansion of the underlying screen. In another embodiment, the openings are created by shapes that have a weakened edge that, as a result of expansion break off to create available openings for flow.

DETAILED DESCRIPTION OF THE DRAWINGS

DETAILED DESCRIPTION OF THE PREFERRED EMBODIMENT

Figure 1:
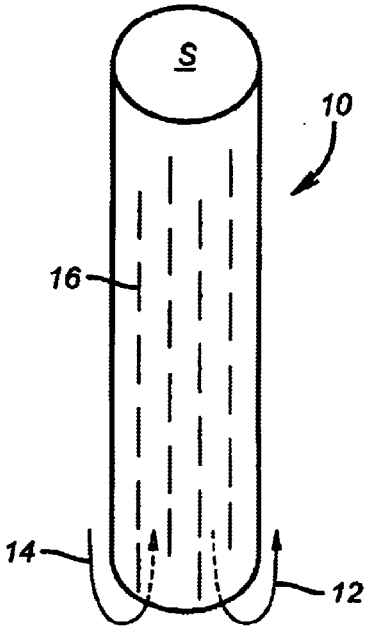
FIG. 1 is an elevation view of one embodiment of a cover for a screen prior to expansion.
Figure 2:
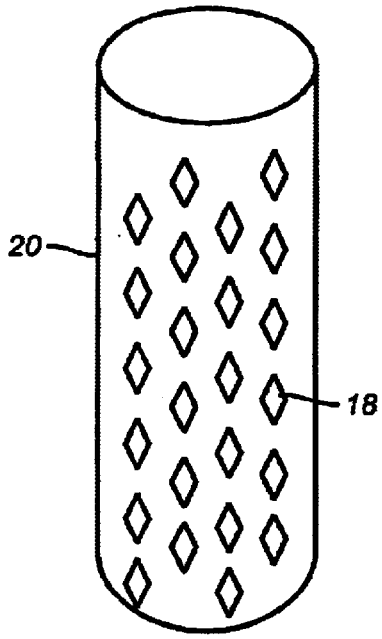
FIG. 2 is the view of FIG. 1 after the screen is expanded.

FIG. 1 shows one embodiment of the sleeve 10. It has a cylindrical shape to fit over a screen S so as to effectively close off its openings (not shown) in the event there is circulation, represented by arrow 12 or reverse circulation, represented by arrow 14 when the screen S is being run into position covered by sleeve 10. Sleeve 10 has a plurality of slits 16 that are shown arranged in longitudinal rows, although other arrangements or a random pattern is within the scope of the invention. The slits 16 are preferably straight but they don't have to be. The slits 16 can be right through the sleeve 10 during run in over their entire length. Alternatively, they may just be surface depressions to concentrate stress during expansion of sleeve 10 such that the depressed areas rip and create the generally diamond shaped openings 18 shown in FIG. 2. In these configurations the sleeve 10 can be seamless or have a welded or fused seam 20. In another variation, the seam 20 can be designed to break on expansion of the screen S so that either the entire sleeve 10 drops away from the screen S during expansion or it stays in the vicinity of screen S with a partially or totally failed seam 20 and some or all of the slits or depressions 16 having opened as openings 18. The slits or depressions 16 can be made from a succession of very small openings that are large enough to concentrate stress on expansion to create openings 18, yet small enough on run in to block any significant flow through screen S.

Figure 3:
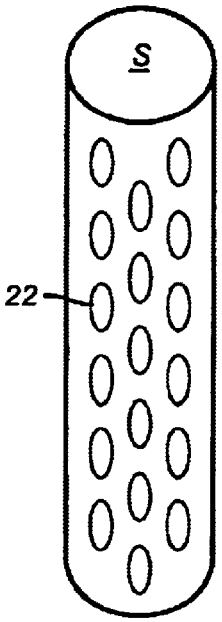
FIG. 3 is an alternative embodiment of the cover for the screen prior to screen expansion.
Figure 4:
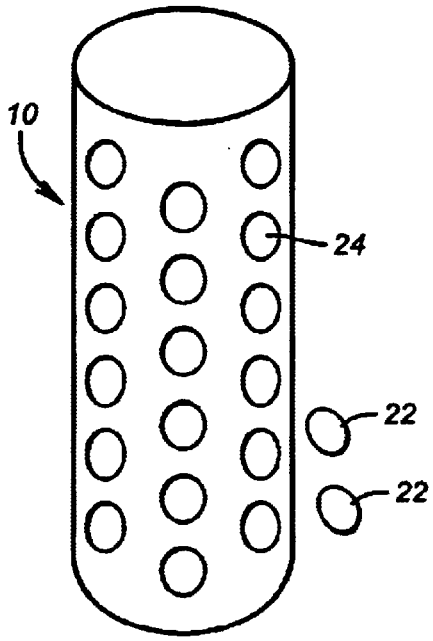
FIG. 4 is the view of FIG. 3 after screen expansion.

FIGS. 3 and 4 show oval, elliptical or circular or schematically other shapes 22 that define a depression, a series of small perforations, or partial cut-through locations. Upon expansion of the screen S, the shapes 22 formed as previously described part away fully or partially from the balance of the sleeve 10 to create a plurality of openings 24. Openings 24 may be fully open or may have partial cover depending on whether the shape 22 has fully separated or partially separated from sleeve 10 due to the expansion of screen S. Comparing FIG. 4 to FIG. 3, it can be seen that the expansion has changed the shape of the openings 24 from the point of the shape they had when covered by shapes 22. FIG. 4 schematically shows that the shapes 22 may fall away as a result of expansion of screen S. As before, the embodiment of FIGS. 3 and 4 can have a seam that partially or totally fails on expansion of screen S. The results can vary from having the entire sleeve 10 fall away due to expansion or it can slide down with some or all of the shapes that initially act as covers 22 falling away or being otherwise displaced to open fully or in part one or more openings 24.

The sleeve 10 can be used with a variety of known screens. It can protect the screen from damage during run in from physical impacts. It can also close off the openings in the screen to moving well fluids in either direction. The screen S is less likely to be obstructed when it is expanded into contact with the wellbore. The sleeve 10 can have openings develop due to expansion in a variety of ways. Covers 22 can move or fall away leaving openings 24 for screen access. The sleeve can also have a seam that comes apart totally or partially. It can be a scroll retained by bands that yield or fail allowing the scroll to partially or totally unravel and/or slits 16 or covers 22 to create access paths such as 18 or 24.

The above description is illustrative of the preferred embodiment and many modifications may be made by those skilled in the art without departing from the invention whose scope is to be determined from the literal and equivalent scope of the claims below:

I claim:

1. A method of well completion, comprising:

covering an exterior surface of screen with a substantially extensible sleeve;

running the assembled screen and sleeve downhole;

configuring said sleeve to allow some flow, during a circulation or reverse circulation or run in, through radial flow paths through said screen;

expanding said screen and said sleeve without severing said sleeve from a top to a bottom end; and enlarging said flow paths in said screen by said expanding.

2. The method of claim 1, comprising:

providing a plurality of lines on said sleeve;

increasing stress along said lines due to said expanding;

separating said sleeve along said lines.

3. The method of claim 2, comprising:

making said plurality of lines straight.

4. The method of claim 3, comprising:

making said plurality of lines parallel.

5. The method of claim 4, comprising:

aligning said parallel lines with the longitudinal axis of said screen.

6. The method of claim 3, comprising:

creating diamond shaped openings in said sleeve by said separation along said lines.

7. The method of claim 2, comprising:

configuring said lines in a closed geometric shape.

8. The method of claim 7, comprising:

defining covers for potential openings in said sleeve with said geometric shapes.

9. The method of claim 2, comprising:

forming said lines by scoring said sleeve.

10. The method of claim 2, comprising:

forming said lines by a plurality of adjacent perforations.

11. A method of well completion, comprising:

covering a screen with a sleeve;

running the assembled screen and sleeve downhole;

expanding said screen;

providing flow paths to said screen by said expanding;

releasing said sleeve from said screen by said expanding.

12. The method of claim 11, comprising:

allowing the sleeve to move away from said screen; and engaging the wellbore with the screen.

13. A method of well completion, comprising:

covering a screen with a sleeve;

running the assembled screen and sleeve downhole;

expanding said screen;

providing flow paths to said screen by said expanding;

providing a plurality of lines on said sleeve;

increasing stress along said lines due to said expanding;

separating said sleeve along said lines;

configuring said lines in a closed geometric shape;

defining covers for potential openings in said sleeve with said geometric shapes;

separating said covers from said sleeve by said expanding.

14. The method of claim 13, comprising:

changing said closed geometric shape due to said expanding.

15. The method of claim 14, comprising:

changing a circular initial geometric shape to an oval due to said expanding.

16. The method of claim 13, comprising:

blocking all flow through said screen with said sleeve prior to said expanding.

17. The method of claim 16, comprising:

circulating or reverse circulating longitudinally through the body of said screen prior to said expanding.

18. A method of well completion, comprising:

covering a screen with a sleeve;

running the assembled screen and sleeve downhole;

expanding said screen;

providing flow paths to said screen by said expanding;

providing a seam on said sleeve;

breaking said seam at least in part from said expanding.

19. A method of well completion, comprising:

covering a screen with a sleeve;

running the assembled screen and sleeve downhole;

expanding said screen;

providing flow paths to said screen by said expanding;

providing said sleeve in the form of a scroll;

securing said scroll to said screen;

releasing said scroll at least in part by said expanding.

* * * * *